US007330682B2

(12) United States Patent
Shinshi

(10) Patent No.: US 7,330,682 B2
(45) Date of Patent: Feb. 12, 2008

(54) APPARATUS CAPABLE OF APPLYING A HIGH FIXING-NIP PRESSURE WHICH IS EASILY RELEASED WHEN A RECORDING SHEET IS STUCK IN A FIXING MECHANISM

(75) Inventor: Akira Shinshi, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 213 days.

(21) Appl. No.: 11/169,699

(22) Filed: Jun. 30, 2005

(65) Prior Publication Data

US 2006/0002737 A1 Jan. 5, 2006

(30) Foreign Application Priority Data

Jun. 30, 2004 (JP) ..... 2004-194834
Jun. 24, 2005 (JP) ..... 2005-185252

(51) Int. Cl.
*G03G 15/20* (2006.01)
*G03G 21/16* (2006.01)

(52) U.S. Cl. ..... 399/122; 399/124

(58) Field of Classification Search ..... 399/122, 399/124, 320, 322, 328, 329
See application file for complete search history.

(56) References Cited

U.S. PATENT DOCUMENTS 4,428,660 A * 1/1984 Matsumoto ..... 399/122
5,708,926 A * 1/1998 Sagara et al. ..... 399/122
5,956,547 A * 9/1999 Kamei et al. ..... 399/122
6,035,160 A * 3/2000 Kim ..... 399/122
6,621,997 B2 * 9/2003 Chung ..... 399/122
6,882,820 B2 4/2005 Shinshi et al.

FOREIGN PATENT DOCUMENTS

| | | |
|---|---|---|
| EP | 0 902 337 | 3/1999 |
| JP | 05-173446 | 7/1993 |
| JP | 2004-214718 | 8/2000 |
| JP | 2001-188437 | 7/2001 |
| JP | 2001-318555 | 11/2001 |
| JP | 2002-040862 | 2/2002 |

OTHER PUBLICATIONS

U.S. Appl. No. 11/477,662, filed Jun. 30, 2006, Shinshi et al.
U.S. Appl. No. 11/521,472, filed Sep. 15, 2006, Shinshi et al.
U.S. Appl. No. 11/519,007, filed Sep. 12, 2006, Shinshi et al.
U.S. Appl. No. 11/669,699, filed Jan. 31, 2007, Shinshi.
European Search Report

* cited by examiner

*Primary Examiner*—William J. Royer
(74) *Attorney, Agent, or Firm*—Oblon, Spivak, McClelland, Maier & Neustadt.P.C.

(57) ABSTRACT

An image forming system includes an image forming mechanism and a fixing mechanism. The fixing mechanism includes first and second fixing members configured to face each other to hold recording materials, a lock member, a pressuring lever, a pressure release lever and an elastic member. The pressure release lever turns between a lock position for a regular operation mode and a release position. The elastic member pulls the lock member capturing the pressuring lever to apply pressure to the first and second fixing members at the far end from the instantaneous center of the pressuring lever at the lock position.

9 Claims, 5 Drawing Sheets

FIG. 7B
(AMENDED)
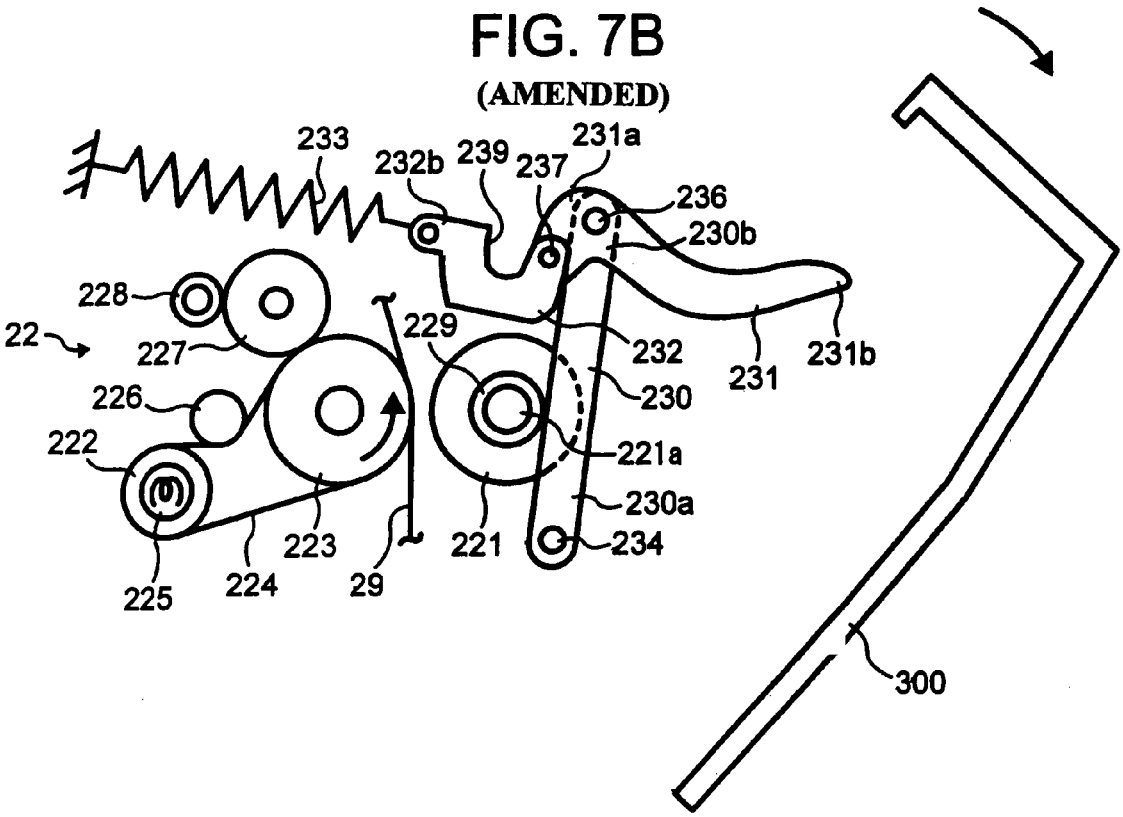

APPARATUS CAPABLE OF APPLYING A HIGH FIXING-NIP PRESSURE WHICH IS EASILY RELEASED WHEN A RECORDING SHEET IS STUCK IN A FIXING MECHANISM

This patent application claims priority from Japanese patent application, No. 2004-194834, filed on Jun. 30, 2004 in the Japanese Patent Office, the entire contents of which are incorporated by reference herein.

BACKGROUND OF THE INVENTION

1. Field of the Invention

The present invention generally relates to a method and apparatus for forming images and more particularly to a method and apparatus which is capable of applying a high fixing-nip pressure that is easily released when a recording sheet is stuck in a fixing mechanism.

2. Discussion of the Background

An image forming system that uses an electrophotographic method forms an electrostatic latent image on a photosensitive surface of an image support member (i.e., a photosensitive member) and develops the electrostatic latent image into a visible toner image using a developer including toner. The image forming system transfers the developed toner image onto a recording material such as a paper sheet, for example, and fixes the toner image to the recording material under heat and pressure with a fixing member.

The fixing member includes a pair of rollers serving as a pair of rotary members facing each other. As an alternative to the pair of rollers, a pair of belts or combination of a roller and a belt may be used. Also, as an alternative to the pair of rotary members, a pair of stationary members such as a pair of pressure pads can be used. As a further alternative, a combination of a rotary member and a stationary member can also be used.

One of the pair of rollers which is referred to as a heat roller includes a heater inside, and the other roller which is referred to as a pressure roller applies pressure to the heat roller. Thus, the pair of rollers which rotate together constantly form a pressure nip therebetween into which the recording material having the toner image is inserted and an image fixing process is performed as the recording material is moved forward by the pair of rollers.

When the image forming system causes a paper sheet jam in which the recording material is stuck in the fixing member, the system usually stops operations in order to allow operators to remove the recording material stuck in the fixing member. The recording material is, however, tightly held at the pressure nip by the pair of rollers and therefore it is not easy to remove the recording material.

To make the removal of jammed recording material easy, the image forming system is provided with a mechanism for releasing pressure, e.g., a pressure release lever.

There are increasing market demands for the background image forming system to become smaller and faster. On one hand, as a result of downsizing, the fixing member needs to be smaller and the width of the pressure nip for pressing and forwarding the recording material consequently becomes smaller. On the other hand, as a result of increasing a processing speed, the fixing member provides a smaller amount of heat to the recording material. Therefore, by these two phenomena, the fixing performance tends to be degraded.

To make the fixing member transfer a sufficient amount of heat to the recording material, the pressing force applied between the heat roller and the pressure roller needs to be increased so that the pressure nip becomes greater. If the pressing force is so increased, however, it becomes difficult to release the pressure between the heat roller and the pressure roller with the pressure releasing mechanism such as the pressure release lever.

SUMMARY OF THE INVENTION

The specification describes a novel image forming apparatus capable of applying a high fixing-nip pressure that is easily released when a recording sheet is stuck in a fixing mechanism. As one example, a novel image forming system includes an image forming mechanism and a fixing mechanism. The fixing mechanism includes first and second fixing members configured to face each other to hold recording materials, a lock member configured to have first and second end portions and a locking portion located between the first and the second end portions, a pressuring lever configured to have one end pivotably held, a pressure release lever having a first portion at one end turnably holding the lock member and a second portion turnably holding the pressuring lever at another end of the pressuring lever and configured to turn between a lock position and a release position so that the first portion is located between the second portion and the locking portion of the lock member when the pressure release lever is at the release position and the second portion is located at the locking portion of the lock member when the pressure release lever is at the lock position and an elastic member configured to pull the lock member capturing the second portion of the pressure release lever in a direction from the first fixing member to the second fixing member at the lock position.

The specification further describes a novel fixing apparatus which includes a unique structure for the fixing mechanism. The fixing mechanism includes the lock member having a hollow portion formed at an upper side of the locking portion in the lock member, a first shaft arranged at the first portion of the pressure release lever to turnably hold the lock member and a second shaft arranged at the second portion of the pressure release lever to turnably hold the pressuring lever so that a position of an axis center of the second shaft is arranged on a pulling force line of the elastic member at the lock position and the first end portion of the lock member is arranged at a position to fasten an engagement of the lock member to the second shaft.

Further, the specification describes a novel fixing apparatus which includes another unique structure of fixing mechanism. The outer end of the pressure release lever is arranged in conjunction with a cover and the pressure release lever is capable of moving in accordance with the movement to open or close the cover.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 7A and 7B illustrate another fixing apparatus of the image forming system of FIG. 1 in a regular operation mode with the cover closed and in a pressure nip release mode with the cover opened, respectively.

DETAILED DESCRIPTION OF PREFERRED EMBODIMENTS

Figure 1:
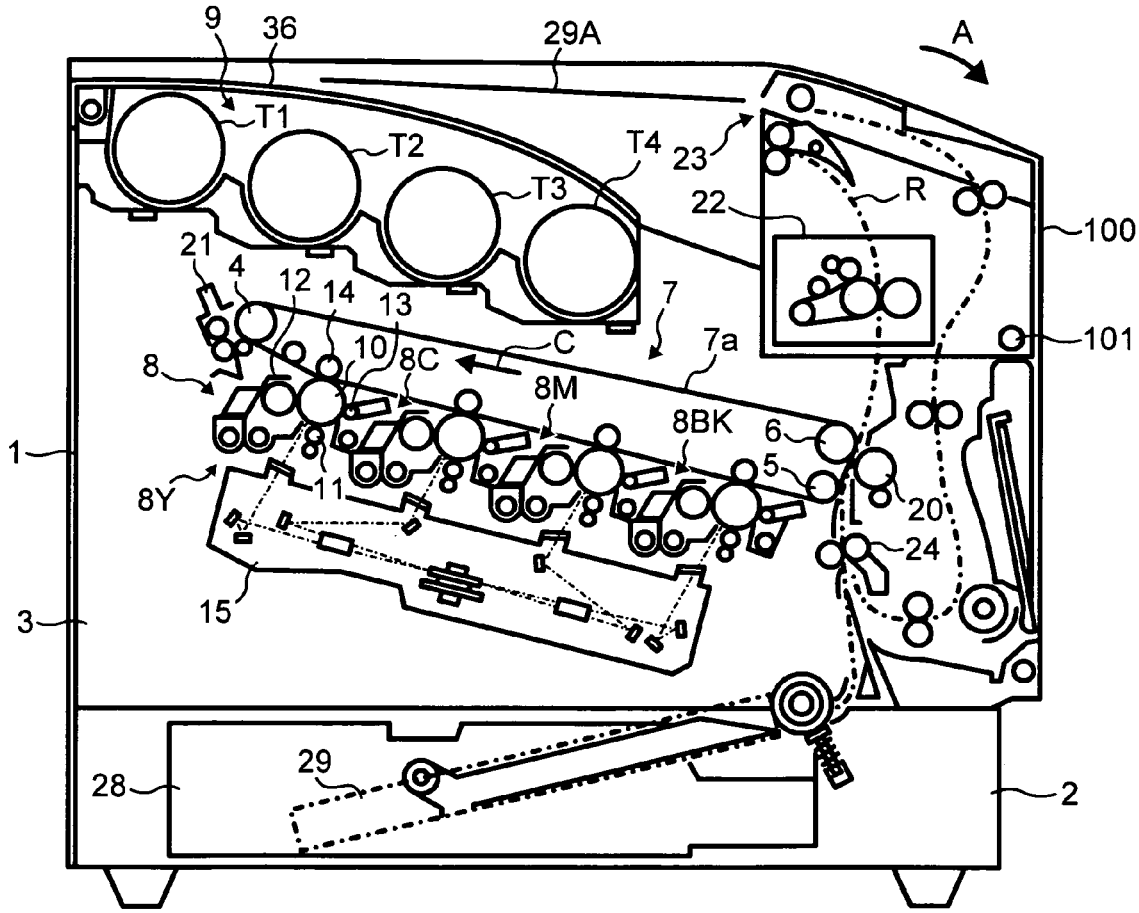
FIG. 1 illustrates a basic configuration of an image forming system according to one embodiment of the present invention.

In describing preferred embodiments illustrated in the drawings, specific terminology is employed for the sake of clarity. However, the disclosure is not intended to be limited to the specific terminology so selected and it is to be understood that each specific element includes all technical equivalents that operate in a similar manner.

For example, a printer installed in an image forming system is disclosed in this specification. However the disclosure is applicable to other similar equipment such as copiers and facsimiles.

FIG. 1 illustrates a basic configuration of a printer 1 as one example of an image forming system. The printer 1 may be arranged at the lower part of the image forming system. The printer 1 includes a paper storage section 2, an image forming section 3, a fixing apparatus 22, a paper holding section 36, a toner supply section 9 and a cover 100. The paper storage section 2 includes a paper cassette 28 which stores paper sheets 29. The fixing apparatus 22 fixes a toner image on the paper sheets 29 and the configuration of the fixing apparatus 22 will be discussed later in detail. The paper holding section 36 holds printed paper sheets 29A. The paper sheets 29 are carried through a carrier track R between the paper storage section 2 and the paper holding section 36 via the fixing apparatus 22. The image forming section 3 includes an intermediate transfer unit 7, an image forming device 8, a light-writing unit 15, a secondary transfer roller 20 and resist rollers 24. The image forming section 3 is placed above the paper cassette 28 in the middle of the printer 1. The intermediate transfer unit 7 includes an endless intermediate transfer belt 7*a*, a plurality of rollers 4, 5, 6 and a belt cleaning device 21. The endless intermediate transfer belt 7*a* is extended among the rollers 4, 5, 6. The rollers 4 and 5 are configured to support the lower side of the intermediate transfer belt 7*a*. The roller 6 is configured to face the carrier track R. The belt cleaning device 21 is installed at a side of the roller 4 opposite relative to the intermediate transfer belt 7*a* to clean the surface of the intermediate transfer belt 7*a*. The light-writing unit 15 writes images to image holding members. The secondary transfer roller 20 is installed at a side of the roller 6 opposite relative to the intermediate transfer belt 7*a* and configured to face the carrier track R. The image forming device 8 is placed beneath the intermediate transfer belt 7*a* to face the lower surface of the intermediate transfer belt 7*a*. The image forming device 8 includes four image forming units 8Y, 8C, 8M and 8BK each having a respective image holding member. The intermediate transfer unit 7 and the image forming units 8Y, 8C, 8M and 8BK may be configured to be removable from the image forming system. Each one of the image forming units 8Y, 8C, 8M and 8BK includes a photosensitive drum 10, a charging member 11, a development member 12, a cleaning member 13 and a first transfer roller 14. The charging member 11, the development member 12 and the cleaning member 13 are arranged around the photosensitive drum 10. The photosensitive drum 10 is configured to face the intermediate transfer belt 7*a* and works as the image holding member. The first transfer roller 14 is installed at an inner side of the intermediate transfer belt 7*a* and an opposite side of the photosensitive drum 10 relative to the intermediate transfer belt 7*a*. The image forming units 8Y, 8C, 8M and 8BK are similarly configured in this system. For simplicity, the label numbers are indicated for the image forming unit 8Y, as shown in FIG. 1. A difference between the image forming units 8Y, 8C, 8M and 8BK is the color of the toner used as a developer. Each one of the image forming units 8Y, 8C, 8M and 8BK contains yellow, cyan, magenta and black color toner, respectively. When the toner stock in the corresponding development member 12 dwindles, the toner is supplied from a corresponding one of toner supply bottles T1, T2, T3, T4 arranged at the toner supply section 9 in the upper part of the printer 1. The light-writing unit 15 is arranged underneath the image forming device 8 and electrostatically forms an image on the surface of the photosensitive drum 10 by irradiating a laser beam.

The intermediate transfer unit 7, the image forming device 8, the toner supply section 9 and the light-writing unit 15 may be arranged with a tilt of predetermined angle relative to the horizontal direction for the purpose of space-saving. At the beginning of an image forming process, the photosensitive drum 10 is driven to rotate in a clockwise direction by a driver (not shown). The surface of each one of the photosensitive drums 10 is charged uniformly by the charging member 11 for making an electrostatic latent image. The electrostatic latent image is then formed on the surface of the each photosensitive drum 10 by being irradiated by the laser beam. The data used for the irradiation is the single color information data broken down from the full color information data to each color information data, (i.e., yellow, cyan, magenta and black). While the photosensitive drum 10 passes through the point of the development member 12, the electrostatic latent image is visualized as a toner image. One of the rollers 4, 5, 6 is driven to rotate in a counterclockwise direction by a driver (not shown).

In accordance with the rotation of the roller, the intermediate transfer belt 7*a* is subjected to move in the direction, as shown by an arrow C in FIG. 1. The other rollers are also subjected to move by the intermediate transfer belt 7*a*. A yellow toner image is formed at the image forming unit 8Y which includes the development member 12 with yellow toner and is transferred on the intermediate transfer belt 7*a* by the first transfer roller 14. A full color toner image is formed on the intermediate transfer belt 7*a* by superimposing cyan, magenta and black toner images in addition to the yellow toner image with the similar process. After the transfer process is completed, remaining toner on the surface of the photosensitive drum 10 is then removed by the cleaning member 13, and the electricity on the surface of the intermediate transfer belt 7*a* is also removed by a neutralization member (not shown) for initialization to prepare for the next image forming process.

On one hand, the paper sheets 29 are fed from the paper cassette 28 to the resist rollers 24 through the carrier track R. The paper sheets 29 are then held by the resist rollers 24. In accordance with a timing determined by a detector (not shown) placed at the resist rollers 24 which locate between the paper cassette 28 and the secondary transfer roller 20, the paper sheets 29 are carried to the secondary transfer roller 20. On the other hand, an opposite polarity potential relative to the charge on the toner is applied to the secondary transfer roller 20. The toner image on the surface of the intermediate transfer belt 7*a* is then transferred to a paper 29 due to the force of the potentials. After the transferring process, the paper sheet 29 holding the toner image is carried to the fixing apparatus 22. While the paper sheet 29 is passing through the fixing apparatus 22, the toner is melted and fixed by heat and pressure. The printed paper sheet 29A holding the fixed toner image is carried to an ejection section 23 which is the last part of the carrier track R and ejected to the paper holding part 36 arranged at the upper part of the printer 1. The remaining toner on the intermediate transfer belt 7*a* is removed by the belt cleaning device 21. As the image forming units 8Y, 8M, 8C and 8BK are arranged in parallel facing the intermediate transfer belt 7*a*, the four toner images are superimposed one after another on the intermediate transfer belt 7*a* during the transfer process. Comparing to other types of printers, such as a printer using a rotary development method which needs four cycles to complete the development process of the full color image, this printer needs a shorter image forming time. Additionally, a more compact system can be achieved because the paper holding section 36 is embedded at the upper part of the printer 1. The operation for the full color image forming is described, however, it is also applicable for forming a single color image forming operation using one of the four image forming units and for two/three color images forming operation in the same way.

As illustrated in FIG. 1, the cover 100 is installed near the fixing apparatus 22 and is configured to be supported by a shaft 101 to enable the cover 100 to be opened and closed. FIG. 1 shows a state of the printer 1 with the cover 100 closed. When the cover 100 is moved to the direction to open as shown by an arrow A, the fixing apparatus 22 is to be exposed and an outer element of the fixing apparatus 22, i.e., a pressure release lever, moves in conjunction with the open/close movement of the cover 100.

Figure 2A:
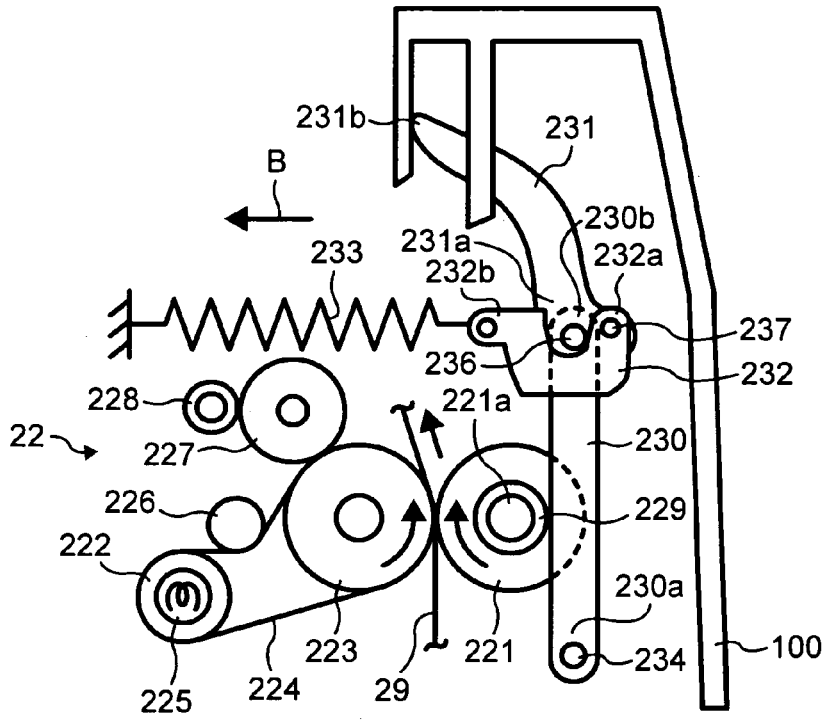
FIGS. 2A and 2B illustrate a fixing apparatus of the image forming system of FIG. 1 in a regular operation mode with a cover closed and in a pressure nip release mode with the cover opened, respectively.
Figure 2B:
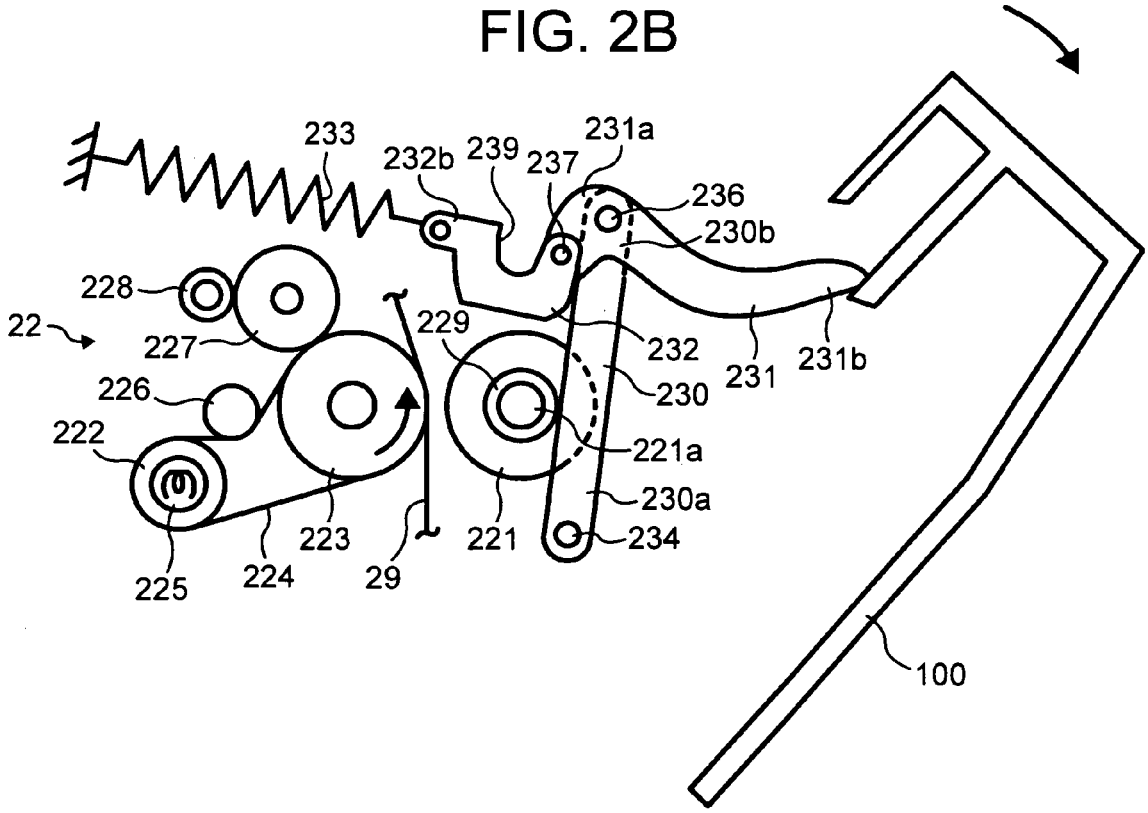

FIGS. 2A and 2B illustrate the fixing apparatus 22 of the printer 1 of FIG. 1 in a regular operation mode with the cover 100 closed and in a pressure nip release mode with the cover 100 opened, respectively.

The fixing apparatus 22 includes a pressuring roller 221, a fixing belt 224 and rollers 222, 223, a belt tension roller 226, a belt cleaning roller 227 and a cleaning brush 228. The pressuring roller 221 is configured to face the fixing belt 224 extended among the rollers 222, 223, as shown in FIG. 2A. The roller 222 which includes a heating source 225 connecting to a power supply (not shown) operates as a heating roller. The roller 223 driven by a motor (not shown) operates as a drive roller. The rollers 222, 223 are turnably supported by a sideboard (not shown). The rollers 222, 223 and the fixing belt 224 rotate in a counterclockwise direction. The pressuring roller 221 is driven to rotate in a clockwise direction by the rotation of the fixing belt 224. The pressuring roller 221 has a cored bar 221*a* in the center which is made of aluminum or iron. The cored bar 221*a* is covered with an elastic layer such as silicon rubber. The surface of the pressuring roller 221 may be coated with a mold-releasing layer such as PFA (Tetra fluoro ethylene-perfluoro alkylvinyl ether copolymer) or PTFE (poly tetra fluoro ethylene). One end of the cored bar 221*a* is rotatably supported by a bearing 229. The bearing 229 is supported by a sideboard (not shown) and configured to make the pressuring roller 221 move closer to, or, apart from the roller 223 so that the pressuring roller 221 moves to contact to, or, release from the fixing belt 224. The heating roller 222 is heated by the heating source 225 such as a halogen heater and an induction heating system. The fixing belt 224 is heated via the heating roller 222.

The electric power for the heating source 225 may be supplied by a sub-power supply system or an electric double layer capacitor instead of a commercial power supply such as 100V. The belt tension roller 226, the belt cleaning roller 227 and the cleaning brush 228 are arranged in the fixing apparatus 22 as shown in FIG. 2A. The fixing apparatus 22 also includes a pressuring lever 230, a pressure release lever 231, a lock member 232 and a coil spring 233 serving as a stopping mechanism. The pressuring lever 230 is configured to apply pressure to the pressuring roller 221. The pressure release lever 231 is configured to turnably hold the pressuring lever 230. The coil spring 233 used as an elastic member is hooked at a second end portion 232*b* of the lock member 232 to pull the lock member 232 to the lock direction shown by an arrow B. The lock member 232 is turnably held by the pressure release lever 231 at a first end portion 232*a* of the lock member 232. And the stopping mechanism is configured to take two positions by rotating the pressure release lever 231 between a lock position where the pressure is applied to the fixing belt 224 and the roller 223 via the pressuring roller 221 and a pressure release position where the pressuring roller 221 is placed separately from the fixing belt 224. One end 230*a* of the pressuring lever 230 is configured to be pivotably held by a shaft 234 which is supported by a sideboard (not shown). The pressure release lever 231 is configured to turnably hold the pressuring lever 230 at a second portion 231*a* of the pressure release lever 231 by a shaft 236 which is another end 230*b* of the pressuring lever 230. An outer end 231*b* of the pressure release lever 231 is configured to slide the inner part of the cover 100 in conjunction with the movement of the cover 100 between the closed position and the opened position. The first end portion 232*a* of the lock member 232 is configured to be turnably supported by a shaft 237 arranged at the second portion 231*a* of the pressure release lever 231. The shaft 237 is configured to move to either side of the shaft 236, when the lock member 232 moves to the lock position as shown in FIG. 2A, or to the release position as shown in FIG. 2B. The shaft 236 acts as a hinge for the pressure release lever 231 in this embodiment. When the lock member 232 is being locked, the shaft 237 moves to the right to locate at the opposite side of the second end portion 232*b* with respect to the shaft 236. When the lock member 232 is being released, the shaft 237 moves to the left to locate at the same side as the second end portion 232*b*. A hollow portion 239 is formed in the middle of the lock member 232 between the first and second end portions 232*a* and 232*b* so that the shaft 236 is captured in the hollow portion 239 to hold the lock member 232 at the lock position as shown in FIG. 2A. The shaft 236 is out of the hollow portion 239 to release the locking at the release position as shown in FIG. 2B. The hollow portion 239 is formed in the upper side of the lock member 232 so that the shaft 236 goes into the hollow portion 239 from the upper side of the lock member 232 in accordance with the movement of the pressure release lever 231 rotating in a counterclockwise direction. At the lock position, the hollow portion 239 in the lock member 232 may locate right above the pressuring lever 230 so that the lock member 232 is supported by the pressuring lever 230. When the printer 1 changes the mode from a regular operation mode with the cover 100 closed as shown in FIG. 2A to a pressure nip release mode with the cover 100 opened as shown in FIG. 2B, the pressure release lever 231 rotates in a clockwise direction in accordance with the movement of the outer end 231*b* of the pressure release lever 231 by the force of the cover 100. As the first end portion 232*a* of the lock member 232 goes down by rotating the pressure release lever 231, the shaft 236 is coming out of the hollow portion 239. After the shaft 236 comes out of the hollow portion 239, the shaft 237 begins to move to the left side of the shaft 236 because the lock member 232 is pulled by the coil spring 233. Then the coil spring 233 may return to a relaxation state with its natural length. When the lock member 232 moves further to the left side with regard to the shaft 236, the pressure release lever 231 is pushed down due to the force by the weight of the cover 100 in addition to the pulling force of the coil spring 233 as shown in FIG. 2B. In accordance with the movement, the pressuring lever 230 moves to an outer direction of the printer 1, closer to the cover 100, the pressure to the pressuring roller 221 is then released. On the other hand, when the printer 1 changes the mode from the pressure nip release mode with the cover 100 opened as shown in FIG. 2B to the regular operation mode with the cover 100 closed as shown in FIG. 2A, the pressure release lever 231 and the pressuring lever 230 move to the left direction in FIG. 2A in accordance with the movement of the outer end 231*b* of the pressure release lever 231 pushed by the cover 100. When the pressuring roller 221 pushed by the pressuring lever 230 contacts the fixing belt 224, the movement of the pressuring lever 230 is restricted and the pressure release lever 231 begins to rotate about the shaft 236 in a counterclockwise direction. In accordance with the rotation of the pressure release lever 231, the shaft 236 enters into the hollow portion 239. The lock member 232 moves to the right in FIG. 2A against the force of the coil spring 233. When the shaft 236 has been captured in the hollow portion 239, the movement of the pressure release lever 231 is restricted and the lock member 232 capturing the shaft 236 is pulled by the coil spring 233 towards the direction B. As the pressure release lever 231 is held at the lock position, the pressure from the pressuring roller 221 to the fixing belt 224 is kept constant.

According to this embodiment, both weight reduction and cost reduction can be achieved because no external drives such as a motor are installed. In addition, easy installing and exchanging of parts is possible because no force from the coil spring 233 is applied when the cover 100 is opened. Moreover, even if a paper sheet jam takes place, the paper sheet 29 can be removed easily because the pressure nip has already been released when the cover 100 is opened.

At the lock position, the lock member 232 capturing the shaft 236 is pulled by the far end from the instantaneous center of the pressuring lever 230. Therefore, smaller coil power is enough to generate sufficient pressure based on the principle of leverage. Moreover, the power which the shaft 236 of the stopping mechanism experiences while moving along the lock member 232 is also small compared to the case in which the stopping mechanism locates closer to the instantaneous center of shaft 234. As a result, high durability of the stopping mechanism can be achieved.

Figure 3:
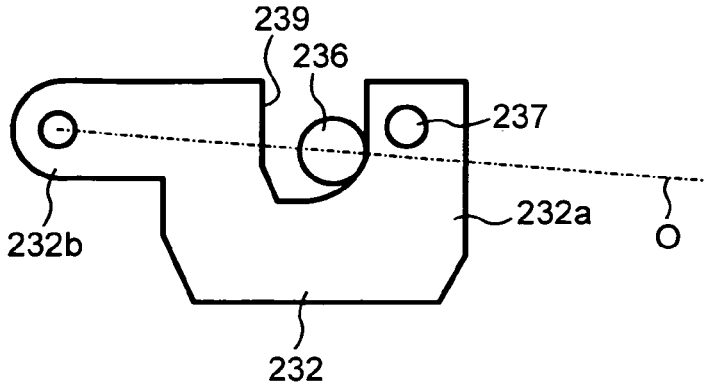
FIGS. 3-5 illustrate variations of a stopping mechanism included in the fixing apparatus of FIG. 2A.

FIG. 3 illustrates one embodiment of the stopping mechanism with a positional relationship between the lock member 232 and the shafts 236, 237. While the pressure release lever 231 is moving to the lock position, the shaft 237 is moving up. When the shaft 237 crosses an extension line O drawn from the points of the second end portion 232*b* of the lock member 232 and the shaft 236, the movement of the lock member 232 rotating in a counterclockwise direction is restricted by the shaft 236. Then, the lock member 232 stops rotating and the position of the lock member 232 can be kept. On the contrary, when the pressure release lever 231 is moving to the release position, the shaft 237 rotates in a clockwise direction in accordance with the movement of the pressure release lever 231. Even after the shaft 237 goes down below the extension line O, the shaft 237 keeps rotating by the force of the coil spring 233 until the coil spring 233 returns to the relaxation state with its natural length.

Unstable pressure from the pressuring roller 221 to the fixing belt 224 generally results in deviation in the width of the pressure nip and causes a problem such as incomplete or overfixed image forming (a cold offset or a hot offset). However, this embodiment can avoid such problem because the same length of the coil spring can be obtained at the lock position restricting the movement of the lock member 232 in the left direction in FIG. 3. Consequently, a constant and repeatable pressure to the fixing belt can be ensured at the lock position.

Figure 4:
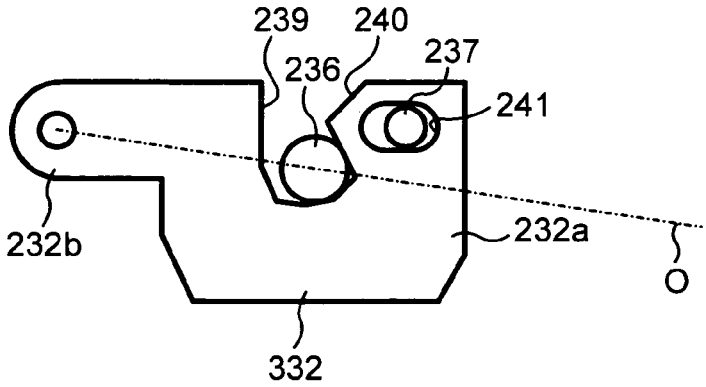

FIG. 4 illustrates another embodiment of the stopping mechanism with a positional relationship between a lock member 332 which includes a detent 240 and the shafts 236, 237. The detent 240 is formed at a side closer to the first end portion 232*a* in the hollow portion 239 of the lock member 332 so that the shaft 236 gets into a stable lock position even when the pressure release lever 231 is not fully rotated and the detent prevents the shaft 236 from escaping from the hollow portion 239. The lock member 332 may have an elongate hole 241 formed at the first end portion 232*a* of the lock member 332 so that the shaft 237 is fixed by the edge of the elongate hole 241 at the lock position. According to this embodiment, it is possible to ensure the stable holding at the lock position and providing a stable pressure condition.

Figure 5:
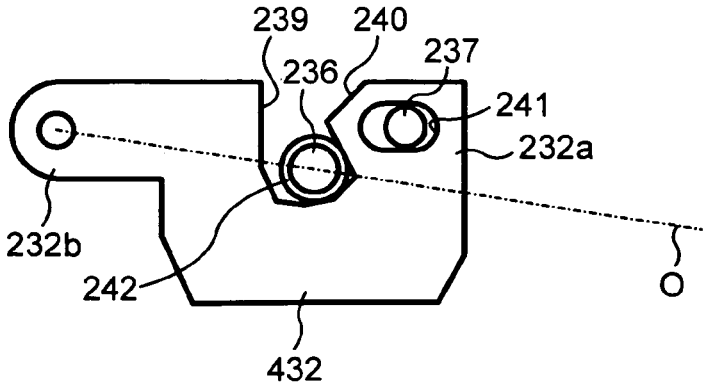

FIG. 5 illustrates another embodiment of the stopping mechanism with a positional relationship between a lock member 432 which includes a detent 240 and the shafts 236, 237. A bearing 242 is introduced to support the shaft 236 to avoid sliding friction between the shaft 236 and the detent 240. According to the embodiment, the destruction due to the accumulated damage by the sliding friction can be avoided because the bearing 242 goes over the detent 240 with rolling friction instead of sliding friction. As a result, high durability of the stopping mechanism can be achieved.

Figure 6:
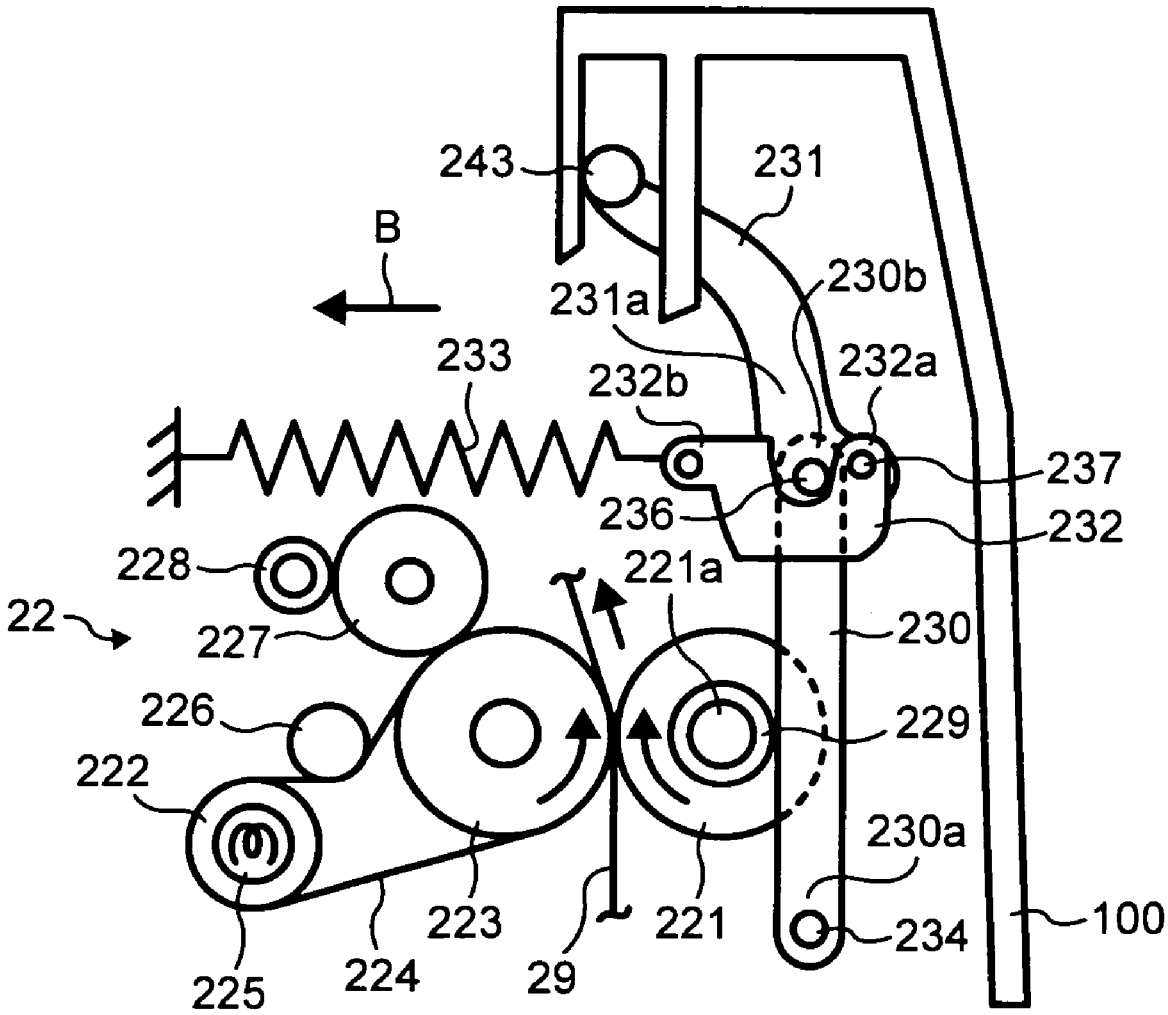
FIG. 6 illustrates another fixing apparatus including a pressure release lever having a pulley at the top thereof.

FIG. 6 illustrates another embodiment of the fixing apparatus 22 which includes a pulley 243 at the outer end 231*b* of the pressure release lever 231. The pulley 243 is configured to be rotatably supported by the pressure release lever 231 so that it is possible to open or close the cover 100 with less power.

Figure 7A:
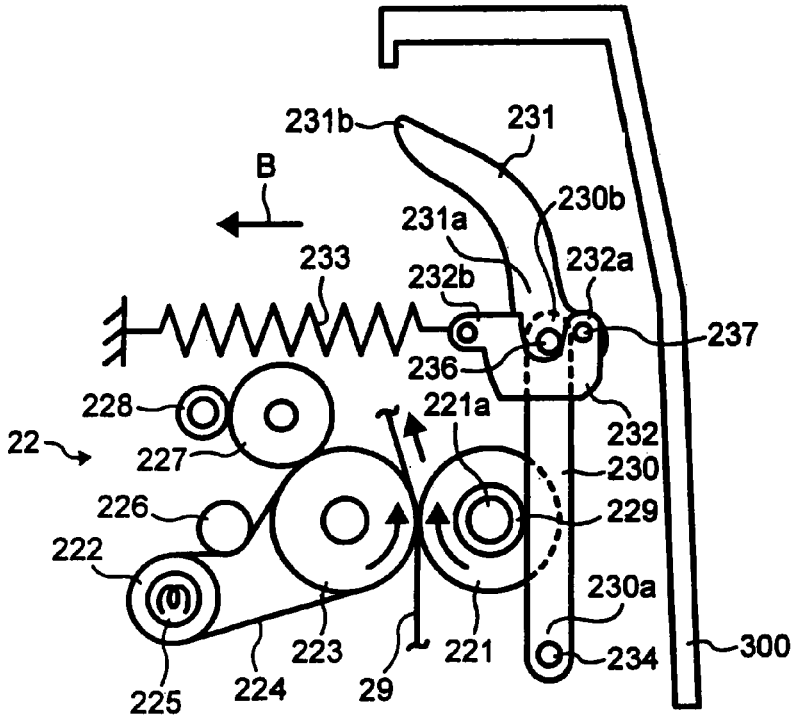

FIG. 7A illustrates another fixing apparatus 22 at a regular operation where a cover 300 moves independently of the member of the fixing apparatus 22.

FIG. 7B illustrates another fixing apparatus 22 at the pressure nip release operation where the cover 300 moves independently of the member of the fixing apparatus 22.

The outer end 231*b* of the pressure release lever 231 is not in conjunction with the cover 300. When the cover 300 is opened, the user may pull manually the pressure release lever 231 so as to release the pressure to the roller 223 and the fixing belt 224.

Numerous additional modifications and variations are possible in light of the above teachings. It is therefore to be understood that within the scope of the appended claims, the disclosure may be practiced otherwise than as specifically described herein.

What is claimed is:

1. An image forming apparatus, comprising:

an image forming mechanism; and a fixing mechanism configured to fix an image on a recording material, and comprising:

first and second fixing members configured to face each other to hold the recording material;

a lock member configured to have first and second end portions and a locking portion located between the first and the second end portions;

a pressuring lever configured to have one end pivotably held;

a pressure release lever having a first portion at one end turnably holding the lock member and a second portion turnably holding the pressuring lever at another end of the pressuring lever and configured to turn between a lock position and a release position so that the first portion is located between the second portion and the locking portion of the lock member when the pressure release lever is at the release position and the second portion is located at the locking portion of the lock member when the pressure release lever is at the lock position; and an elastic member configured to pull the lock member capturing the second portion of the pressure release lever in a direction from the first fixing member to the second fixing member at the lock position.

2. The image forming apparatus according to claim 1, further comprising;

a hollow formed at an upper side of the locking portion in the lock member, a first shaft arranged at the first portion of the pressure release lever to turnably hold the lock member, a second shaft arranged at the second portion of the pressure release lever to turnably hold the pressuring lever.

3. The image forming apparatus according to claim 2, comprising;

wherein a position of an axis center of the second shaft is arranged on a pulling force line of the elastic member at the lock position and the first end portion of the lock member is arranged at a position to fasten an engagement of the lock member to the second shaft.

4. The image forming apparatus of claim 2, further comprising;

a detent formed at a side opposite relative to the elastic member in the hollow of the lock member to prevent the second shaft from escaping from the hollow.

5. The image forming apparatus of claim 2, further comprising;

a hole formed at the first end portion of the lock member has an elliptical ring structure, wherein the first shaft is fixed by the edge of the hole at the lock position.

6. The image forming apparatus of claim 2, further comprising;

a bearing configured to support the second shaft.

7. The image forming apparatus according to claim 1, wherein an outer end of the pressure release lever is arranged in conjunction with a cover and the pressure release lever is capable to move in accordance with a movement to open or close the cover.

8. The image forming apparatus of claim 7, further comprising;

a pulley arranged at an outer end of the pressure release lever touching a surface of the cover.

9. An image forming apparatus, comprising:

an image forming mechanism; and a fixing mechanism comprising:

first and second fixing members configured to hold a recording material;

a pressuring member having one end pivotably held and configured to apply pressure to the first fixing member;

a pressure release lever configured to release the pressure by turning from a lock position where the pressure is applied to the second fixing member via the first fixing member to a release position where the pressure is released;

a lock member configured to capture the pressuring member at another end of the pressuring member at the lock position; and an elastic member configured to pull the lock member capturing the pressuring member in a direction from the first fixing member to the second fixing member at the lock position.

* * * * *